US006260746B1

(12) United States Patent
Abdi

(10) Patent No.: US 6,260,746 B1
(45) Date of Patent: Jul. 17, 2001

(54) GARMENT HANGER

(75) Inventor: Abraham Abdi, Orange, CA (US)

(73) Assignee: Merrick Engineering, Inc., Corona, CA (US)

( * ) Notice: Subject to any disclaimer, the term of this patent is extended or adjusted under 35 U.S.C. 154(b) by 0 days.

(21) Appl. No.: 09/618,909

(22) Filed: Jul. 18, 2000

(51) Int. Cl.[7] ..... A47G 25/14
(52) U.S. Cl. ..... 223/85; 223/92
(58) Field of Search ..... 223/88, 85, 92, 223/95, DIG. 4

(56) References Cited

U.S. PATENT DOCUMENTS

D. 200,942 * 4/1965 Goldin ..... 223/85
4,709,838 * 12/1987 Campbell ..... 223/DIG. 4
5,806,727 * 9/1998 Joseph ..... 223/85
6,036,062 * 3/2000 Von Fabris Auf Mayerhofen 223/85

* cited by examiner

*Primary Examiner*—Bibhu Mohanty
(74) *Attorney, Agent, or Firm*—G. Donald Weber, Jr.

(57) ABSTRACT

This invention is directed to garment hangers which are particularly adapted for use with clothes having small neck openings and wherein the hook engages a swivel connector of the hanger adjacent the midsection of the hanger.

19 Claims, 2 Drawing Sheets

131
133
122
126
140
127

501
502

100
175A
175
175B
M
4
5
5
126
122
127
140
132
131
133
152
135
129
137
101
121
124

GARMENT HANGER

BACKGROUND OF THE INVENTION

1. Field of the Invention

This invention relates to garment hangers, in general, and, more particularly, to hangers which have a swivel hook and are especially useful with garments having relatively small collar or neck openings.

2. Prior Art

Many garment hangers are known in the art. The known hangers have many shapes and configurations related to specific uses of the hangers. One such use is a hanger for use with a garment having a relatively small neck opening.

The most pertinent prior art known discloses a hanger structure wherein the hanger support structure (i.e. hook) and the hanger arms are specifically interrelated with a convex, angulated leg extension of the hanger support structure in order to effectively lengthen the perimeter distance along one hanger arm while still achieving a common interconnection location between upper ends of the two shoulder supports of the hanger and the lower end of the angular leg extension of the hook. In the known hanger structures, the support structure or hook is fixed in position relative to the hanger arms.

U.S. Pat. No. 2,164,4100 to Petty discloses a wire clothes hanger for a garment having a comparatively small neck. However, the Petty hanger requires an integrally associated garment retaining means to hold the garment on the hanger.

U.S. Pat. No. 3,485,423 to Wagar et al discloses a wire hanger potentially usable for clothes having small neck openings. The lower end of one hanger shoulder support is joined by a continuous wire to the upper end of the other shoulder support. However, the Wagar et al '423 hanger has geometric restrictions and is relatively inconvenient and cumbersome to use.

U.S. Pat. No. 5,806,727 to Joseph discloses a plastic hanger for garments having a small neck opening but requires a J-slot configuration of the hanger and does not have a swivel hook.

U.S. Pat. No. 5,649,653 to Joseph discloses a plastic hanger for garments having a small neck opening but requires an angled knee in the hook portion of the hanger which hook portion does not swivel.

Nevertheless, there is still a need for new and improved clothes hangers which are adapted for use with small-necked garments and which overcome and avoid such prior art problems while providing unique features such as a swivel hook therefor. The present invention satisfies this need.

SUMMARY OF THE INVENTION

This invention is directed to an improved garment hanger particularly adapted for use with clothes having small neck openings and with the additional advantage of a hook which is able to swivel to provide the advantages of such a hook structure. The hook is selectively detachable from the hanger body.

The hanger includes two opposed support arms for supporting a garment. The support arms are joined together at a mid-region location. In addition to an upper support surface, the support arms may also include a lower surface in the form of a common connecting leg. The hanger also includes a hanger hook which is swivelably mounted to an elongated hook attachment leg which extends from one of the two support arms of the hanger. The connection between the hook attachment leg and the support arm is offset from the mid-region location between the support arms. The attachment leg of the hook is generally coplanar with the support arms.

Because the attachment leg of the hook is off-center relative to the hanger, one support arm of the hanger has, effectively, a greater unobstructed perimeter distance than the other support arm of the hanger. This arrangement permits the longer arm to be inserted through a garment neck whereby the garment can be advanced along the longer arm to a location where the shorter arm can be slipped through the neck and into o the garment. This configuration of the hanger avoids and prevents damage to the garment neck region.

In addition, the hanger may include a shaped support, for example, but not limited to an inverted V-shaped portion, in one of the support arms to complement the attachment leg of the hook structure in the other support arm in order to better receive the garment thereon.

Also, in one embodiment, the hanger structure may include a strengthening support ribs formed on, or as part of, the basic hanger components to add strength and rigidity thereto.

The preferred embodiments of the hanger are simple, rugged and economical to fabricate and manufacture and can be made with various materials and various production processes.

The objects and advantages of the several embodiments will be apparent to those skilled in the art from the present specification taken with the accompanying drawings and the appended claims.

DETAILED DESCRIPTION

Figures 1, 2, 5:
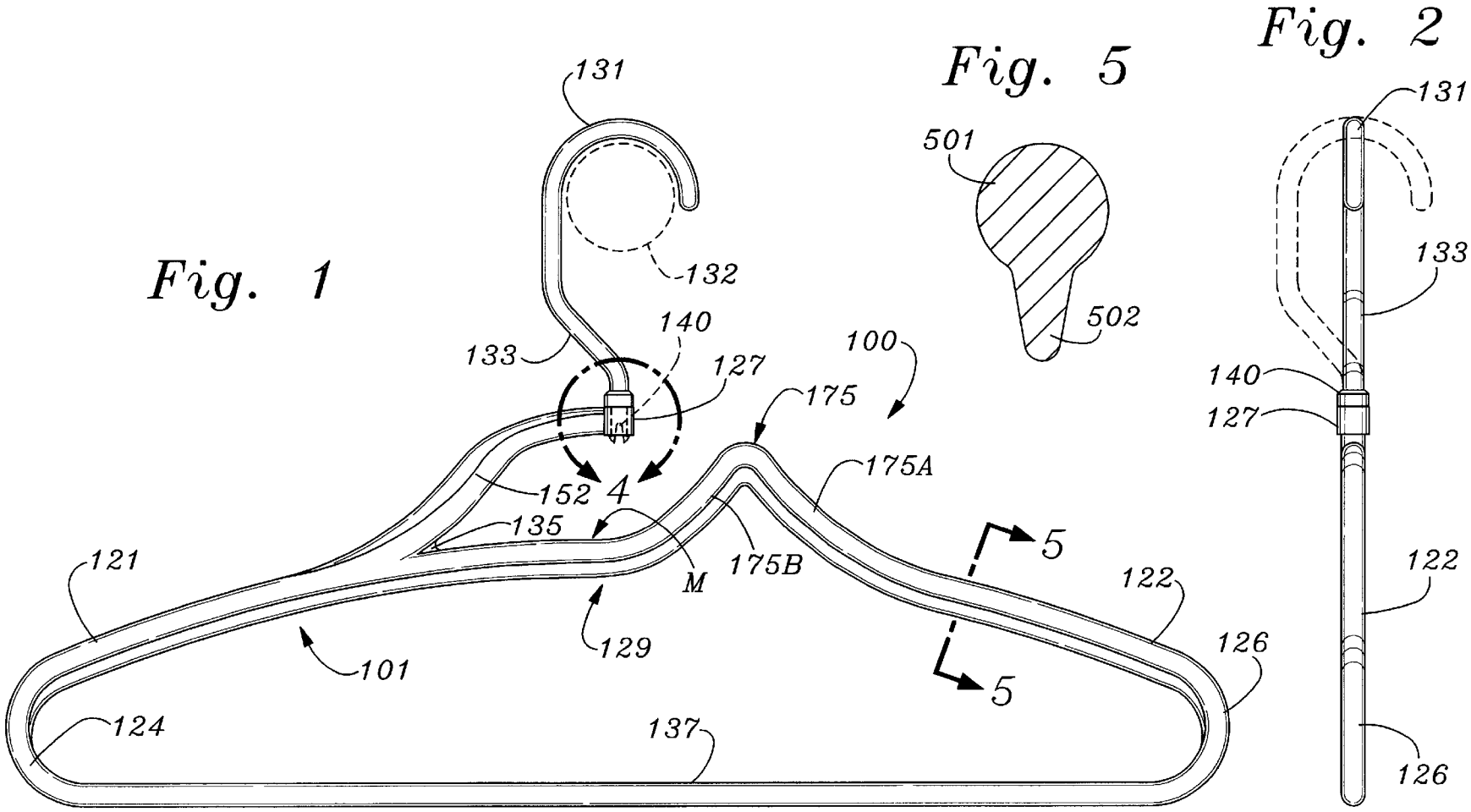
FIG. 1 is a side elevational view of one embodiment of a garment hanger of the instant invention showing a conventional closet support rod in dotted outline.
FIG. 2 is an end elevational view of the hanger of FIG. 1 taken from the right end of the hanger as shown in FIG. 1.
FIG. 5 is a cross-sectional view taken along the lines 5—5 of a portion of the hanger embodiment shown in FIG. 1.

Referring to FIG. 1, there is shown a side elevation view of garment hanger 100 which represents one embodiment of the instant invention. Hanger 100 includes a garment support rod 101 which incorporates two elongated arms 121 and 122 and a mid-region 129. Each of the arms 121 and 122 is adapted for supporting a different shoulder of a garment. Preferably, arms 121 and 122 are about equal to each other in length in hanger 100. The inner ends of arms 121 and 122 are joined together by mid-length 129 to form the continuous support rod 101. In the preferred embodiment, each arm 121 and 122 extends generally downwardly relative to the other arm and relative to the mid-region 129, as well Arms 121 and 122 have an outer end 124 and 126. respectively, which in a preferred embodiment, is rounded for convenience in mounting a garment onto the hanger.

Optionally, but preferably, the outer ends 124 and 126 of hanger 100 are interconnected by an elongated lower cross member 137. Such interconnections are, preferably, integrally formed and curved in order to avoid catching or snagging any portion of a garment.

The hanger 100 incorporates a hook 131, for supporting the hanger from a closet rod 132 or the like (shown in dashed outline in FIG. 1). When so hung, the relationship between the hook 131 and the arms 121 and 122 is such that the arms 121 and 122 are in a generally symmetrical balanced relationship relative to one another and to the mid-region 129. The hook has smoothly arcuate connecting leg 133 which terminates at a connecting end 140 (seen best in FIG. 3). The end 140 is rotatably inserted into and joined to the connecting leg 152 at a joinder receptacle 127. The connecting leg is, preferably, a smoothly arcuate leg which extends upwardly from arm 121 of hanger 100. A support fillet 135 may be provided between connecting leg 152 and arm 121, if desired. The connecting leg 152 is of the appropriate length whereby joinder receptacle 127 is quite closely aligned, spatially, with the center M of the mid region 129 and, thus, the middle of the overall hanger length. As a result, an unobstructed perimeter distance extends from the outer end 126 along arm 122 to a location that is substantially past the midpoint M of the hanger length. Thus, when the arm 122 is inserted into the neck region of a garment, the arm 122 is advanceable through the neck region, past the midpoint M until the neck of the garment is adjacent to the lower portion of hook connecting leg 152.

In the embodiment shown, hanger 100 includes a knee 175 which extends upwardly from the upper arm 122 thereof. The outer side 175A of knee 175, preferably, curves in the opposite direction to, i.e. is complementary to, the connecting leg 152 of the hook 131. Thus, the outer side 175A of the knee 175 and the lower end of the connecting leg 152 form complimentary arcuate regions for receiving a garment on the hanger 100.

Conversely, the inner side 175B of the knee 175 is returned to the arm 122 at approximately the mid-point M of the hanger. Thus, the knee 175 is located somewhat short of the mid-region 129 and about equidistant therefrom relative to the joinder location 127.

It should be understood that while hanger 100 includes a generally inverted, V-shaped knee 175 which extends upwardly from upper arm 122, the "knee" can take any similar configuration with the inner and outer legs as shown. Alternatively, only the outer leg 175A of the "knee" which, typically, extends in the opposite direction to the connecting leg 122 need be utilized. That is, the inner leg 175B of the knee can be omitted, if so desired.

Referring now to FIG. 2, there is shown an elevation view of hanger 100 taken from the right end thereof (i.e. end 126) in FIG. 1. It is seen that in the preferred embodiment, the hanger 100, including the combination of the arms 121 and 122 the hook 131, the connecting leg 133, and the cross member 137 have a generally flat or planar configuration although the hook 131 can rotate 360° around the axis of connector end 140 in joinder location 127. The hanger 100 is typically, formed of a rod-shaped material but is not limited thereto.

Figure 3:
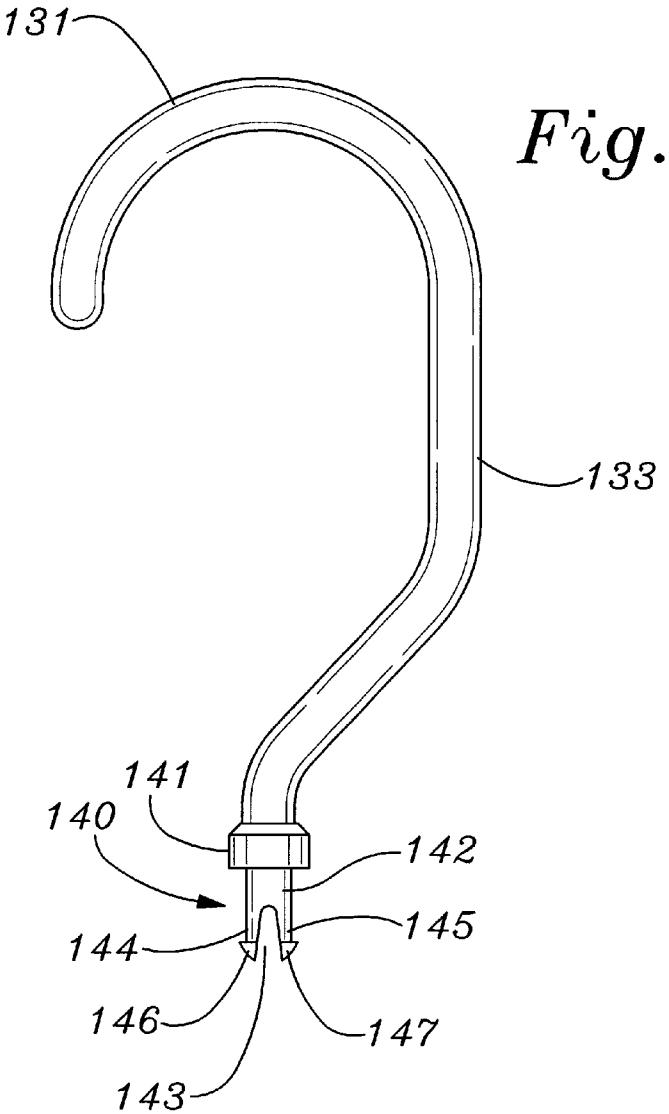
FIG. 3 is an enlarged side elevational view of the hook portion of the garment hanger of the instant invention as shown in FIG. 1.

Referring now to FIG. 3, there is shown a slightly enlarged, elevation side view of the hook 131 which includes the upper arcuate end for engaging a hanger rod 132 or the like (see FIG. 1). The connecting leg 133 is appropriately formed with several arcuate bends so that the connector end 140 is disposed substantially beneath the center point of the hook 131.

In the preferred embodiment, the connector end 140 comprises a collar 141 which is slightly larger in diameter than the connecting leg 133. The collar 141 limits the passage of connector end 141 through the joinder 127 as described infra.

The connector end 140 includes an elongated body 142 which extends axially from the collar 141 and is an extension of the connecting leg 133. The body 142 is, typically, slightly smaller in diameter than the connecting leg 133 although this is not absolutely required.

The body 142 is bifurcated at the end thereof by a slot 143 which is, typically, slightly tapered. Thus, the body 142 has two adjacent spaced apart ends 144 and 145. Because of the construction of body 142, including slot 143, the ends 144 and 145 are adapted to flex slightly toward each other under pressure and then to return to the original position as shown when the pressure is removed.

The ends 144 and 145 include the enlarged retaining nubs 146 and 147 which extend outwardly relative to the body 142. Thus, as will be described infra, the ends (and nubs) flex inwardly when passed through the connector joinder 127 and expand after passing therethrough thereby to prevent the hook 131 from being readily disengaged from the hanger. The nubs 146 and 147 can be forced together, if desired, in order to selectively release the hook 131 from the joinder receptacle 127.

Figure 4:
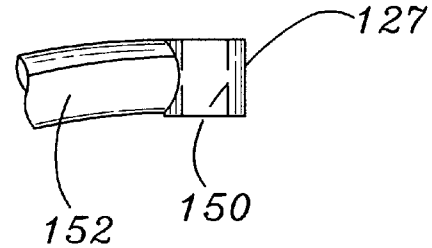
FIG. 4 is an enlarged view of a portion of the swivel receptacle of the garment hanger of the instant invention shown in FIG. 1.

Referring now to FIG. 4, there is shown an enlarged view of the joinder receptacle 127. The joinder receptacle 127 is a tubular element attached to or formed at the end of the connecting leg 152 to receive the body 142 of connector end 140. The joinder end 127 includes a central bore 150 therethrough. In particular, the ends and nubs of the hook (see FIG. 3) are passed through the bore 150 in the tubular joinder receptacle 127 until the ends and the nubs expand and latch on the lower side of the joinder receptacle 127.

Referring concurrently to FIG. 5, there is shown a cross-sectional view of the structure of hanger 100 taken along the lines 5—5 in FIG. 1. Thus, as seen in FIGS. 1 and 5, the structure of hanger 100 includes a generally cylindrical body 501 which is fairly conventional in plastic hanger construction.

In addition, the structure of hanger 100 includes a tapered, generally triangular shaped support portion 502 formed integrally with the cylinder 501. The support portion or tail 502 can be on the bottom of the cylinder (or rod), as seen in arms 121 and 122 in FIG. 1. Alternatively, the support tail 502 can be on the top of the rod as seen in connecting leg 152 in FIG. 1. The tail 502 is not required in all hangers but provides an appropriate structural strength as desired and may be utilized with any of the hanger embodiments described supra.

Each of the hanger embodiments described supra can be constructed of various conventional materials using various conventional construction methods For example, the hanger can be comprised of molded or preformed plastic with a tubular or rod cross section with or without the support tail Hangers can be variously otherwise formed using for example, preformed plastic rodding, plastic extrusions, plastic coated wire, plastic tubing, metal tubing, mixtures thereof or the like, as desired by a fabricator. Various conventional working and forming procedures can be used to fabricate a single hanger such as compression or laser cutting and/or heat forming.

Thus, there is shown and described a unique design and concept of a garment hanger. While this description is directed to several embodiments, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A garment hanger comprising, first and second elongated arms arranged for supporting the opposed shoulders of a garment, each of said first and second elongated arms having an outer end and an inner end, said outer ends spaced apart relative to one another, said inner ends joined together by a mid-region section to form a continuous support between said outer ends, an inverted V-shaped knee formed in said first elongated arm intermediate the outer end thereof and said mid-region location, a connecting arm extending from said second elongated arm and disposed above said mid-region section, a joinder receptacle at the free end of said connecting arm, and a suspending device for hanging said hanger so that said first and second arms are in a generally symmetrical, balanced relationship relative to one another and to said mid-region section, said suspending device having an elongated connecting leg the lower end of which comprises a connector end which selectively engages said joinder receptacle.

2. The hanger recited in claim 1 wherein, said suspending device includes a hook member.

3. The hanger recited in claim 1 wherein, said mid-portion of said elongated connecting leg defines an arcuate configuration.

4. The hanger recited in claim 1 wherein, said mid-portion of said elongated connecting leg defines an angled figuration.

5. The hanger recited in claim 1 including, an extension of a second of said first and second arms which extends above the second arm at a complimentary angle relative to said lower end of said elongated connecting leg.

6. The hanger recited in claim 5 including.

a return component between said extension and said mid-region section.

7. The hanger recited in claim 1 including, a support member formed on at least one of said first and second elongated arms and said elongated connecting leg to provide enhanced strength thereto.

8. The hanger recited in claim 7 wherein, said support member comprises a tapered fillet integrally formed with the respective hanger component.

9. The hanger recited in claim 1 including, a third elongated arm spaced apart from said first and second elongated arms and interconnected between the outer ends thereof.

10. A garment hanger comprising, a pair of elongated arms for supporting the shoulders of a garment, each of said elongated arms having an outer end and an inner end, connecting means for joining together both said inner ends to form a continuous mid-region location, an elongated connecting arm the lower end of which terminates at a first one of said pair of elongated arms intermediate the outer end thereof and said mid-region location and an upper end which extends above said first one of said pair of elongated arms, an inverted V-shaped knee formed in a second one of said pair of elongated arms intermediate the outer end thereof and said mid-region location, a receptacle connector formed at said upper end of said elongated connecting arm, and suspending means having an arcuate hook at one end thereof and a connector end to rotatably engage said receptacle connector at the other end thereof.

11. The hanger recited in claim 1 wherein.

said connector leg has a lower leg portion with an inclined orientation such that said lower leg portion defines an interior acute angle with an extension of one of said pair of elongated arms.

12. The hanger recited in claim 10 wherein, said suspending means is disposed so that said pair of elongated arms are in a generally symmetrical, balanced relationship relative to one another and to said mid-region location when a garment is hung on said hanger.

13. The hanger recited in claim 10 wherein, said connector and said receptacle connector are rotatably engaged.

14. The hanger recited in claim 1 wherein, said connector and said joinder receptacle are rotatably engaged.

15. The hanger recited in claim 1 wherein, said first and second arms, said connecting leg, and said suspending devices are formed of a rod-shaped material.

16. The hanger recited in claim 15 including, a tapered support integrally formed with the rod-shaped material of said first and second arms and said connecting arm.

17. The hanger recited in claim 10 wherein, said receptacle connector includes a hollow cylinder with the axis thereof substantially perpendicular to the axis of said connecting arm.

18. The hanger recited in claim 17 wherein, said connector at the other end of said suspending means is insertable into said hollow cylinder and self-locking therein.

19. The hanger recited in claim 18 wherein, said connector comprises a bifurcated end of said suspending means which selectively compresses and expands relative to the axis of said hollow cylinder.

* * * * *